US009227752B2

(12) United States Patent
Fitzwater

(10) Patent No.: US 9,227,752 B2
(45) Date of Patent: Jan. 5, 2016

(54) ELEVATED MICROWAVE HEATING TRAY

(71) Applicant: Graphic Packaging International, Inc., Atlanta, GA (US)

(72) Inventor: Kelly R. Fitzwater, Lakewood, CO (US)

(73) Assignee: Graphic Packaging International, Inc., Atlanta, GA (US)

( * ) Notice: Subject to any disclaimer, the term of this patent is extended or adjusted under 35 U.S.C. 154(b) by 289 days.

(21) Appl. No.: 13/897,740

(22) Filed: May 20, 2013

(65) Prior Publication Data

US 2013/0256303 A1 Oct. 3, 2013

Related U.S. Application Data

(63) Continuation of application No. 12/384,855, filed on Apr. 9, 2009, now Pat. No. 8,471,184, which is a continuation of application No. PCT/US2007/082477, filed on Oct. 25, 2007.

(60) Provisional application No. 60/854,482, filed on Oct. 26, 2006.

(51) Int. Cl.
*H05B 6/64* (2006.01)
*B65D 81/34* (2006.01)
(Continued)

(52) U.S. Cl.
CPC .. *B65D 5/42* (2013.01); *B65D 5/52* (2013.01); *B65D 81/3453* (2013.01); *B65D 2581/3406* (2013.01); *B65D 2581/3462* (2013.01); *B65D 2581/3472* (2013.01); *B65D 2581/3477* (2013.01); *B65D 2581/3479* (2013.01); *B65D 2581/3494* (2013.01)

(58) Field of Classification Search
CPC ..... B65D 5/52; B65D 81/3453; B65D 5/42; B65D 2581/3406; B65D 2581/3462; B65D 2581/3477; B65D 2581/3479; B65D 2581/3494; B65D 2581/3472
USPC ..... 219/727, 728, 734, 759; 426/107, 111; 428/34.3, 461, 597, 209, 138
See application file for complete search history.

(56) References Cited

U.S. PATENT DOCUMENTS 1,513,608 A 10/1924 Labombarde
1,908,841 A 5/1933 Hawks
2,656,092 A * 10/1953 Ellsworth ..... 229/164
(Continued)

FOREIGN PATENT DOCUMENTS

EP 0 451 530 A 10/1991
EP 0 503 302 A2 9/1992
(Continued)

OTHER PUBLICATIONS

International Preliminary Report on Patentability—PCT/US2006/035503, Dec. 19, 2007, Graphic Packaging International, Inc.
(Continued)

*Primary Examiner* — Quang Van
(74) *Attorney, Agent, or Firm* — Womble Carlyle Sandridge & Rice, LLP

(57) ABSTRACT

Various blanks and constructs formed therefrom are provided. The various constructs include features for supporting a food item at an elevated position to enhance the heating, browning, and/or crisping of the food item in a microwave oven.

35 Claims, 6 Drawing Sheets

(51) Int. Cl.
*B65D 5/42* (2006.01)
*B65D 5/52* (2006.01)

(56) References Cited

U.S. PATENT DOCUMENTS

| | | | |
|---|---|---|---|
| 2,718,999 | A | 9/1955 | Helmick |
| 2,828,059 | A | 3/1958 | Ross |
| 3,346,399 | A | 10/1967 | Watson et al. |
| 3,368,734 | A | 2/1968 | Wainberg |
| 3,414,182 | A | 12/1968 | Fobiano |
| 3,425,543 | A | 2/1969 | Havvey |
| 3,865,301 | A | 2/1975 | Pothier et al. |
| 4,192,540 | A | 3/1980 | Oliff |
| 4,210,124 | A | 7/1980 | Wilhelm et al. |
| 4,279,374 | A | 7/1981 | Webinger |
| 4,505,391 | A | 3/1985 | Kuchenbecker |
| 4,567,341 | A | 1/1986 | Brown |
| 4,592,914 | A | 6/1986 | Kuchenbecker |
| 4,705,929 | A | 11/1987 | Atkinson |
| 4,775,771 | A | 10/1988 | Pawlowski |
| 4,785,160 | A | 11/1988 | Hart |
| 4,801,774 | A | 1/1989 | Hart |
| 4,826,072 | A | 5/1989 | Hart |
| 4,861,958 | A | 8/1989 | Bohrer et al. |
| 4,865,921 | A | 9/1989 | Hollenberg |
| 4,871,111 | A | 10/1989 | Mode |
| 4,877,932 | A | 10/1989 | Bernstein et al. |
| 4,890,439 | A | 1/1990 | Smart |
| 4,936,935 | A | 6/1990 | Beckett |
| 4,960,598 | A | 10/1990 | Swiontek |
| 4,963,240 | A | 10/1990 | Fukasawa et al. |
| 4,963,424 | A | 10/1990 | Beckett |
| 5,039,364 | A | 8/1991 | Beckett |
| 5,077,455 | A | 12/1991 | Peleg et al. |
| 5,114,034 | A | 5/1992 | Miller et al. |
| 5,117,078 | A | 5/1992 | Beckett |
| 5,144,107 | A | 9/1992 | Peleg |
| 5,153,402 | A | 10/1992 | Quick et al. |
| 5,213,902 | A | 5/1993 | Beckett |
| 5,221,419 | A | 6/1993 | Beckett |
| 5,247,149 | A | 9/1993 | Peleg |
| 5,253,800 | A | 10/1993 | France |
| 5,260,537 | A | 11/1993 | Beckett |
| 5,266,386 | A | 11/1993 | Beckett |
| 5,270,066 | A | 12/1993 | Pawlowski |
| RE34,683 | E | 8/1994 | Maynard |
| 5,340,436 | A | 8/1994 | Beckett |
| 5,354,973 | A | 10/1994 | Beckett |
| 5,357,086 | A | 10/1994 | Turpin et al. |
| 5,400,460 | A | 3/1995 | Roeker et al. |
| 5,410,135 | A | 4/1995 | Pollart |
| 5,424,517 | A | 6/1995 | Habeger |
| 5,519,195 | A | 5/1996 | Keefer |
| 5,544,806 | A | 8/1996 | Anderson et al. |
| 5,628,921 | A | 5/1997 | Beckett |
| 5,672,407 | A | 9/1997 | Beckett |
| 5,688,427 | A | 11/1997 | Gallo, Jr. |
| 5,759,418 | A | 6/1998 | Frater et al. |
| 5,759,422 | A | 6/1998 | Schmelzer |
| 5,800,724 | A | 9/1998 | Habeger |
| 5,948,308 | A | 9/1999 | Wischusen, III |
| 6,114,679 | A | 9/2000 | Lai |
| 6,150,646 | A | 11/2000 | Lai et al. |
| 6,204,492 | B1 | 3/2001 | Zeng et al. |
| 6,251,451 | B1 | 6/2001 | Zeng |
| 6,359,272 | B1 | 3/2002 | Sadek et al. |
| 6,414,290 | B1 | 7/2002 | Cole |
| 6,433,322 | B2 | 8/2002 | Zeng et al. |
| 6,455,827 | B2 | 9/2002 | Zeng |
| 6,552,315 | B2 | 4/2003 | Zeng et al. |
| 6,677,563 | B2 | 1/2004 | Lai |
| 6,717,121 | B2 | 4/2004 | Zeng |
| 6,765,182 | B2 | 7/2004 | Cole |
| 6,960,748 | B2 | 11/2005 | Baker |
| 7,081,286 | B2 | 7/2006 | Benim et al. |
| 8,217,325 | B2 | 7/2012 | Russell |
| 8,471,184 | B2 | 6/2013 | Fitzwater |
| 2004/0023000 | A1 | 2/2004 | Young et al. |
| 2004/0238534 | A1 | 12/2004 | Mast |
| 2005/0230383 | A1 | 10/2005 | Romeo et al. |
| 2006/0049190 | A1 | 3/2006 | Middleton |
| 2007/0056962 | A1 | 3/2007 | Hopkins et al. |
| 2007/0087090 | A1 | 4/2007 | Russell et al. |
| 2009/0218338 | A1 | 9/2009 | Fitzwater |
| 2009/0230126 | A1 | 9/2009 | Fitzwater |
| 2011/0132903 | A1* | 6/2011 | Cole ..... 219/730 |
| 2012/0193351 | A1 | 8/2012 | Russell |

FOREIGN PATENT DOCUMENTS

| | | |
|---|---|---|
| EP | 10001243 | 4/2010 |
| EP | 11 00 2391 | 5/2011 |
| EP | 12004826 | 9/2012 |
| FR | 745 013 A | 5/1933 |
| FR | 943 904 A | 3/1949 |
| FR | 961 269 A | 5/1950 |
| GB | 925 971 A | 5/1963 |
| GB | 2 127 677 A | 4/1984 |
| GB | 2 150 534 A | 7/1985 |
| WO | WO 93/19566 A | 9/1993 |
| WO | WO 2007/033183 | 3/2007 |
| WO | WO 2008/052096 | 5/2008 |
| WO | WO 2008/115272 | 9/2008 |

OTHER PUBLICATIONS

International Preliminary Report on Patentability—PCT/US2007/081462, April 22, 2009, Graphic Packaging International, Inc.

International Preliminary Report on Patentability—PCT/US2007/082477, Apr. 28, 2009, Graphic Packaging International, Inc.

International Preliminary Report and Written Opinion—PCT/US2006/035503, Dec. 21, 2006, Graphic Packaging International, Inc.

International Preliminary Report and Written Opinion—PCT/US2007/081462, Sep. 29, 2008, Graphic Packaging International, Inc.

International Preliminary Report and Written Opinion—PCT/US2007/082477, Mar. 10, 2008, Graphic Packaging International, Inc.

U.S. Appl. No. 12/384,855—Notice of Allowance dated Feb. 25, 2013.

* cited by examiner

ELEVATED MICROWAVE HEATING TRAY

CROSS-REFERENCE TO RELATED APPLICATIONS

This application is a continuation of U.S. patent application Ser. No. 12/384,855, filed Apr. 9, 2009, which is a continuation of International Application No. PCT/US2007/082477, filed Oct. 25, 2007, which claims the benefit under 35 U.S.C. §119(e) of U.S. Provisional Application No. 60/854,482, filed Oct. 26, 2006, all of which are incorporated by reference in their entirety as though fully set forth herein.

TECHNICAL FIELD

The present invention relates to various blanks, constructs, and methods for heating, browning, and/or crisping a food item, and particularly relates to various blanks, constructs, and methods for heating, browning, and/or crisping a food item in a microwave oven.

BACKGROUND

Microwave ovens provide a convenient means for heating a variety of food items, including dough-based products such as pizzas, pies, and sandwiches. However, microwave ovens tend to cook such items unevenly and are unable to achieve the desired balance of thorough heating and a browned, crisp crust. Thus, there is a continuing need for a microwavable package that provides the desired degree of heating, browning, and crisping of the crust or dough of a food item.

SUMMARY

The present invention is directed generally to various blanks, constructs formed from such blanks, and methods of making such blanks and constructs. The various constructs include one or more features that elevate a food item from the turntable and/or the interior floor of the microwave oven. By elevating the food item in this manner, more heat may be retained by and/or directed to the food item, rather than being lost to the turntable or to the floor of the microwave oven. As a result, the microwave heating efficiency is improved significantly.

In one aspect, the present invention contemplates a blank for forming a construct. The blank includes a plurality of adjoined panels, each of which has a first dimension extending in a longitudinal direction and a second dimension extending in a transverse direction substantially perpendicular to the first direction. The plurality of panels includes a main panel, a pair of substantially opposed side panels joined to the main panel along respective substantially opposed longitudinal fold lines, and a pair of substantially opposed end panels joined to the main panel along respective substantially opposed transverse fold lines. In one variation, the blank is substantially symmetrical when viewed along a transverse centerline and/or a longitudinal centerline.

The blank also may include a pair of substantially opposed side portions adapted to be at least partially separated from the blank. Each side portion may be defined by a plurality of tear lines including a pair of substantially opposed transverse tear lines extending substantially across the respective side panel into the main panel and a longitudinal line of disruption extending between the respective pair of substantially opposed transverse tear lines. A pair of end flaps may be joined to respective opposed longitudinal ends of each side panel. In one variation, the end flaps are joined to the respective longitudinal ends of each side panel along respective oblique fold lines.

Various shapes are contemplated for the panels that form the blank. In one example, the main panel is substantially rectangular in shape. In another example, the side panels are substantially trapezoidal in shape. In still another example, the end panels are substantially trapezoidal in shape.

In another aspect, the invention contemplates a construct for heating, browning, and/or crisping a food item in a microwave oven. The construct includes a platform comprising a microwave energy interactive material, a pair of side panels extending substantially downwardly from a first pair of opposed edges of the platform along respective first fold lines extending in a first direction, and a pair of end panels extending substantially downwardly from a second pair of opposed edges of the platform along respective second fold lines extending in a second direction substantially perpendicular to the first direction.

The construct also includes a pair of substantially opposed adjustable wall portions at least partially defined by a pair of substantially vertical tear lines in each side panel. The adjustable wall portions are adapted to be transformed into opposed walls for the platform by tearing along the substantially vertical tear lines in each side panel and rotating the walls upwardly along the respective first fold line. In one variation, the adjustable wall portions are each further at least partially defined by a pair of tear lines extending in the second direction from the respective first fold line into the main panel. Each tear line that extends into the main panel is substantially aligned with the respective vertical tear line in the respective side panel. In another variation, the adjustable wall portions are each further at least partially defined by a line of disruption extending in the first direction substantially between respective endpoints of the pair of tear lines extending into the main panel. In this variation, each adjustable wall portion is adapted to be transformed into a wall for the platform by tearing along the substantially vertical tear lines in the side panel and along the tear lines extending into the main panel. The wall then can be rotated upwardly along at least one of the respective first fold line and the line of disruption extending in the first direction. The adjustable wall portion may have any suitable shape and, in one example, the adjustable wall portion is substantially rectangular in shape.

If desired, the construct may include a pair of end flaps foldably joined to opposed ends of each respective side panel along respective oblique fold lines. The end flaps may be in a substantially contacting, facing relationship with the respective end panel and may be joined to the respective end panel adhesively or otherwise.

In still another aspect, the invention encompasses a construct comprises a platform including a central portion and a pair of end portions disposed at opposed ends of the central portion. The central portion and each of the end portions have a first dimension extending in a first direction and a second dimension extending in a second dimension substantially perpendicular to the second direction. The second dimension of each end portion is greater than the second dimension of the central portion. A plurality of support elements extend substantially downwardly from each end portion of the platform.

The construct further comprises a pair of adjustable side walls. Each wall may include a proximal panel hingedly joined to the central portion of the platform along a first fold line extending in the first direction and a distal panel hingedly joined to the proximal panel along a second fold line extending in the first direction. The proximal panel and the distal panel each have a first dimension extending in the first direction and a second dimension extending in a crosswise direction transverse to the first direction.

In one variation, the first dimension of the proximal panel is approximately equal to the first dimension of the central portion of the platform. In another variation, the second dimension of the proximal panel is approximately equal to one-half of the second dimension of the end portions of the platform minus one-half of the second dimension of the central portion of the platform. In yet another variation, the first dimension of the proximal panel is approximately equal to the first dimension of the central portion of the platform. In still another variation, the plurality of support elements extend substantially downwardly from each end portion of the platform to define a vertical dimension of the platform. The second dimension of the distal panel is approximately equal to the vertical dimension of the platform.

The side walls are adapted to hinge along the first fold line and the second fold line extending in the first direction to bring the side walls into proximity to a food item seated on the platform. In one example, the proximal panel forms an angle with respect to the platform of from about 90° to about 180°. In another example, the distal panel forms an angle with respect to the proximal panel of from about 90° to about 180°. Numerous other configurations are contemplated by the invention.

If desired, the various blanks and/or constructs may include one or more microwave energy interactive elements that enhance the heating, browning, and/or crisping of a food item in a microwave oven. In one example, the microwave energy interactive element comprises a microwave energy interactive material overlying at least a portion of the main panel or platform. In another example, the microwave energy interactive material overlies at least a portion of at least one side panel or wall.

The microwave energy interactive material may be selected from the group consisting of a layer of aluminum, a layer of indium tin oxide, or any combination thereof. The layer of microwave energy interactive material typically may have a thickness of less than about 100 angstroms, for example, from about 60 to about 100 angstroms, but may have any thickness sufficient to convert at least a portion of impinging microwave energy into thermal energy.

If desired, any of the various blanks and/or constructs also may include at least one venting aperture to enhance heating, browning, and/or crisping further.

Other features, aspects, and embodiments will be apparent from the following description and accompanying figures.

BRIEF DESCRIPTION OF THE DRAWINGS

The description refers to the accompanying drawings in which like reference characters refer to like parts throughout the several views, and in which.

DESCRIPTION

The present invention may be understood further by referring to the figures. For simplicity, like numerals may be used to describe like features. It will be understood that where a plurality of similar features are depicted, not all of such features necessarily are labeled on each figure. It also will be understood that various components used to form the blanks and constructs of the present invention may be interchanged. Thus, while only certain combinations are illustrated herein, numerous other combinations and configurations are contemplated hereby.

Figure 1A:
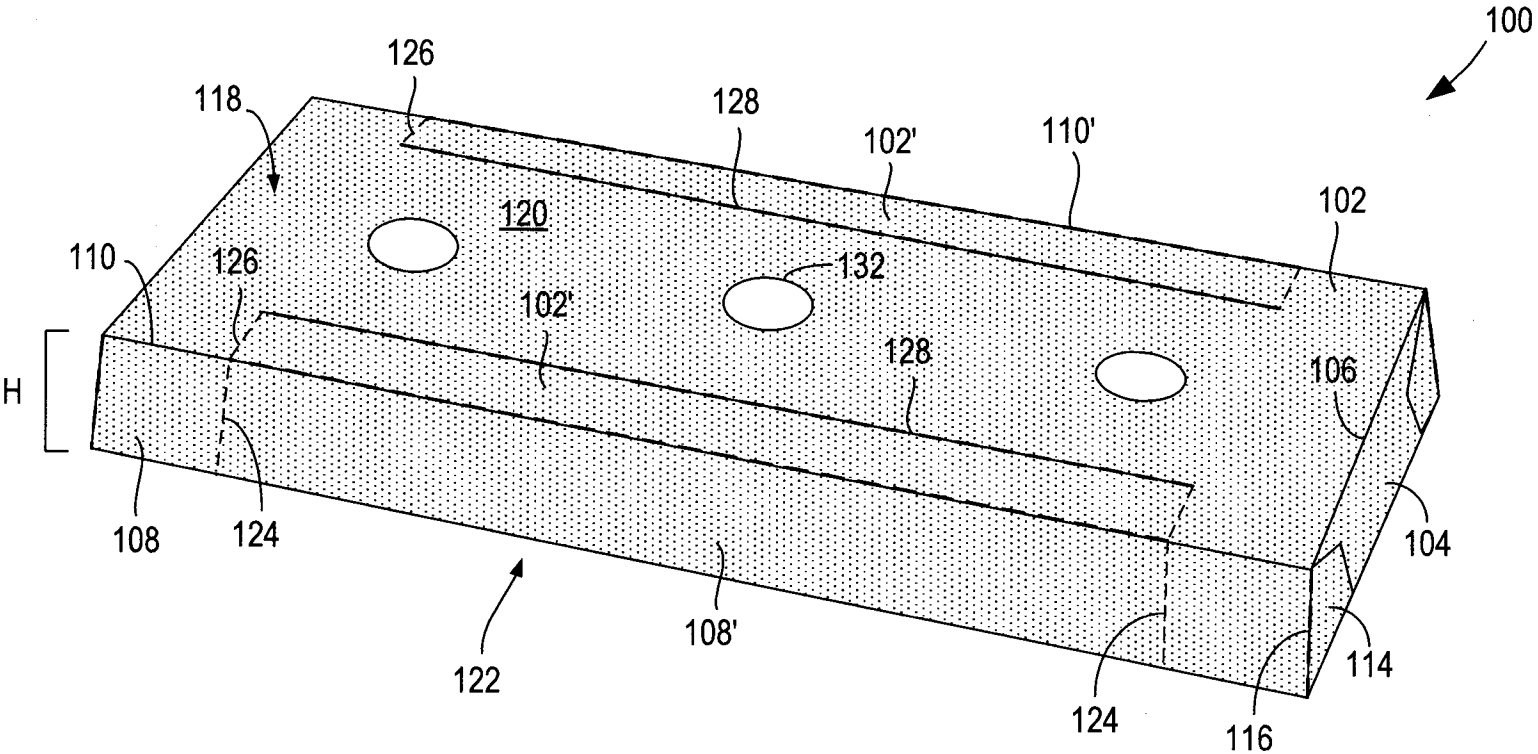
FIG. 1A is a schematic perspective view of an exemplary construct for heating, browning, and/or crisping a food item in a microwave oven, according to various aspects of the invention.

FIG. 1A is a schematic perspective view of an exemplary construct 100 (e.g., tray) for heating, browning, and/or crisping a food item according to various aspects of the invention. The construct 100 includes a main panel 102 that serves as a platform for supporting a food item F, as illustrated schematically in FIG. 1B. The main panel 102 has a substantially planar construction, such that the platform 102 can be said to lie within a substantially horizontal theoretical plane. However, it will be understood that depending on the material used to form the platform 102 and the particular food item F seated on the platform 102, the platform 102 may flex downwardly somewhat, for example, along the longitudinal centerline CL (FIG. 1E), or may otherwise bend or twist. Thus, it will be understood that the "plane" of the main panel or platform 102 (or any other panel) refers an approximation of the plane in which the main panel or platform generally lies and should not be bound to strict or precise mathematical definitions, calculations, or measurements.

In this example, the main panel or platform 102 has a generally rectangular shape suitable, for example, for heating a French bread pizza or sandwich. However, it will be understood that numerous other suitable shapes and configurations may be used to form the platform 102. Examples of other shapes encompassed hereby include, but are not limited to, polygons, circles, ovals, or any other regular or irregular shape. The shape of the platform 102 may be determined by the shape of the food item, and it should be understood that different constructs are contemplated for different food items, for example, sandwiches, pizzas, French fries, soft pretzels, pizza bites, cheese sticks, pastries, doughs, and so forth. The platform 102 may be sized and shaped to receive one portion or multiple portions of one or more different food items.

Figure 1B:
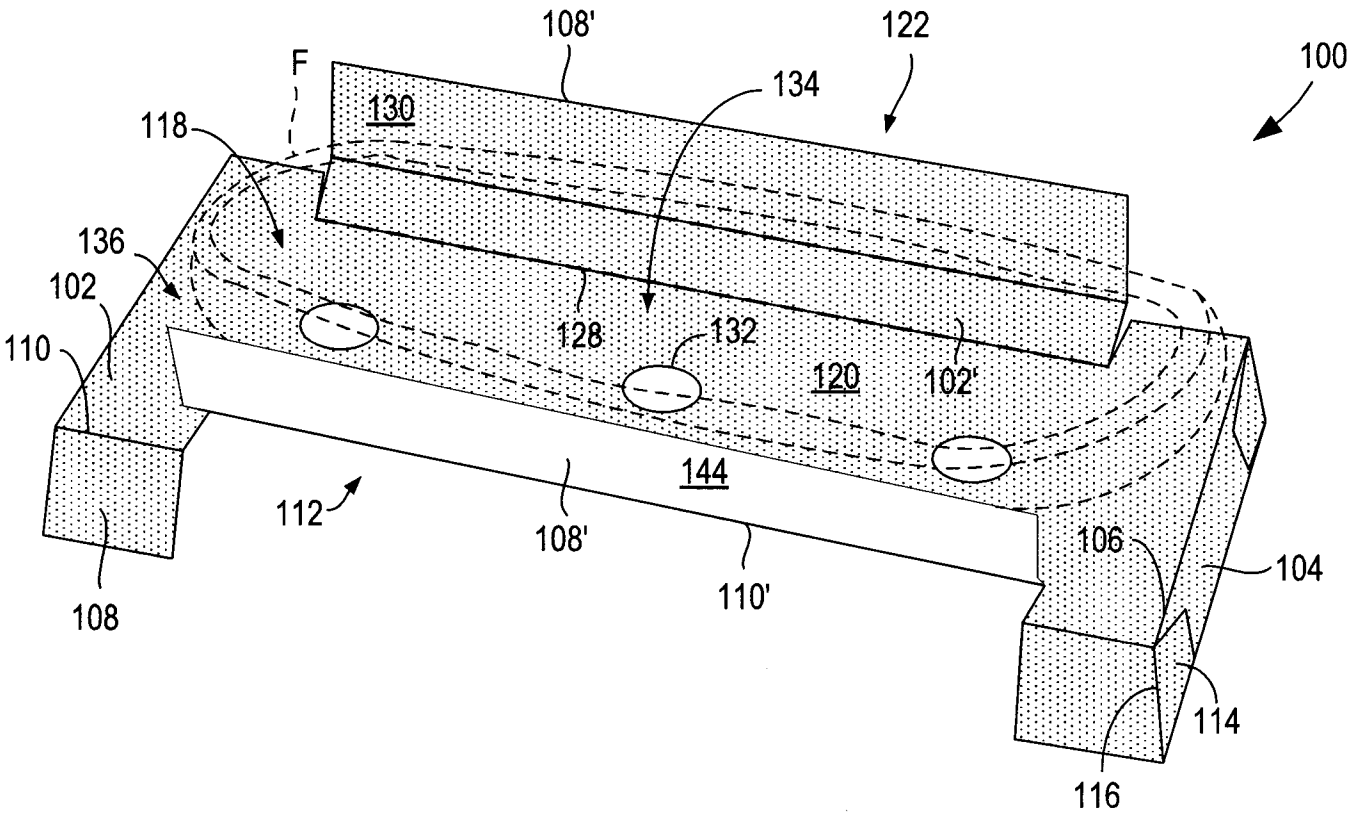
FIG. 1B is a schematic perspective view of the construct of FIG. 1A in use, with the side walls extended upwardly, according to various aspects of the invention.

Still viewing FIG. 1A, the construct 100 includes a pair of substantially opposed end panels 104 foldably joined to the platform 102 along respective lines of disruption, for example, fold lines 106. The construct 100 also includes a pair of substantially opposed side panels 108 foldably joined to the platform along respective lines of disruption, for example, fold lines 110. The end panels 104 and the side panels 108 form non-zero angles with respect to the platform 102, such that, for example, panels 104 and 108 are substantially perpendicular to the platform 102. In this configuration, the end panels 104 and side panels 108 generally maintain the platform 102 in an elevated position and at least partially define a void 112 beneath the platform 102 (FIG. 1B). The platform 102 may be characterized as generally having a height H or substantially vertical dimension approximately equal to that of the end panels 104 and/or side panels 108.

End flaps 114 (i.e., glue flaps) are foldably joined to the side panels 108 along oblique lines of disruption, for example, fold lines 116, which serve as corners or corner edges of the construct 100. The end flaps 114 may be in a substantially facing, contacting relationship with the respective end panels 104 and, if desired, may be joined to the end panels 104 using an adhesive or other suitable material (not shown). Alternatively, the end flaps 114 may extend from the end panels 104 and may be adhered or otherwise joined to the respective side panels 108.

If desired, a microwave energy interactive element 118 (shown schematically by stippling) may overlie, may be joined to, and/or may define at least a portion of a food-contacting side or surface 120 of the platform 102 and, if desired, the outer (exposed) surface of the various other panels, for example, all or a portion of end panels 104, side panels 108, and/or end flaps 114. In one example, the microwave energy interactive element comprises a susceptor that promotes browning and/or crisping of an outer surface of an adjacent food item. However, other microwave energy interactive elements, such as those described below, are contemplated for use with the invention.

It will be understood that some food items, for example, French bread pizza, have a curved or contoured outer surface that may not be able to be browned and/or crisped sufficiently by the susceptor 118 on the platform 102. Thus, according to one aspect of the invention, at least a portion of the construct 100 may be at least partially separated from the construct 100 and reconfigured to bring the microwave energy interactive element 118 into closer proximity with the sides of the food item. According to another aspect of the invention, the construct 100 may include a plurality of lines of disruption that define one or more panels or separable portions that may be transformed into side walls for the platform 102.

For example, in the exemplary construct 100 illustrated schematically in FIG. 1A, a pair of substantially opposed, adjustable side wall portions 122 are defined at least partially by substantially vertical, opposed tear lines 124 in the respective side panels 108, substantially opposed tear lines 126 extending from respective fold lines 110 into the platform 102, and lines of disruption, for example, fold lines 128 extending substantially between the endpoints of respective tear lines 124. Tear lines 124 and 126 are substantially aligned and may cooperate as a single tear line. The side wall portions 122 are adapted to be transformed into side walls 122 for the platform 102 by tearing along tear lines 124, 126 and folding along fold line 128, as illustrated schematically in FIGS. 1B and 1C. The end panels 104 and the remaining portions of the side panels 108 serve as support elements for the platform 102.

In this configuration, a central portion 110' of fold line 110 divides the respective side wall 122 into two sections or panels 108', 102', with distal panel 108' comprising the portion of the respective side panel 108 disposed between respective tear lines 124, and proximal panel 102' comprising the portion of the platform or main panel 102 circumscribed by respective fold lines 110', 128 and respective tear line 126. Fold lines 110', 128 serve as hinges that allow panels 108', 102' to be adjusted individually as needed to bring the susceptor 118 into closer proximity to the surface of the food item F.

It is contemplated that each of panels 102', 108' of the adjustably hinged side walls 122 may be configured in numerous ways to accommodate the shape and dimensions of the food item F (FIG. 1B) seated on the platform 102. In the example illustrated schematically in FIG. 1B, panels 102', 108' extend upwardly and out of the plane of the food bearing panel or platform 102 at non-zero angles with respect to panel 102, such that panels 102', 108' are oblique with respect to one another and with respect to the platform 102. However, numerous configurations are contemplated hereby.

Figure 1C:
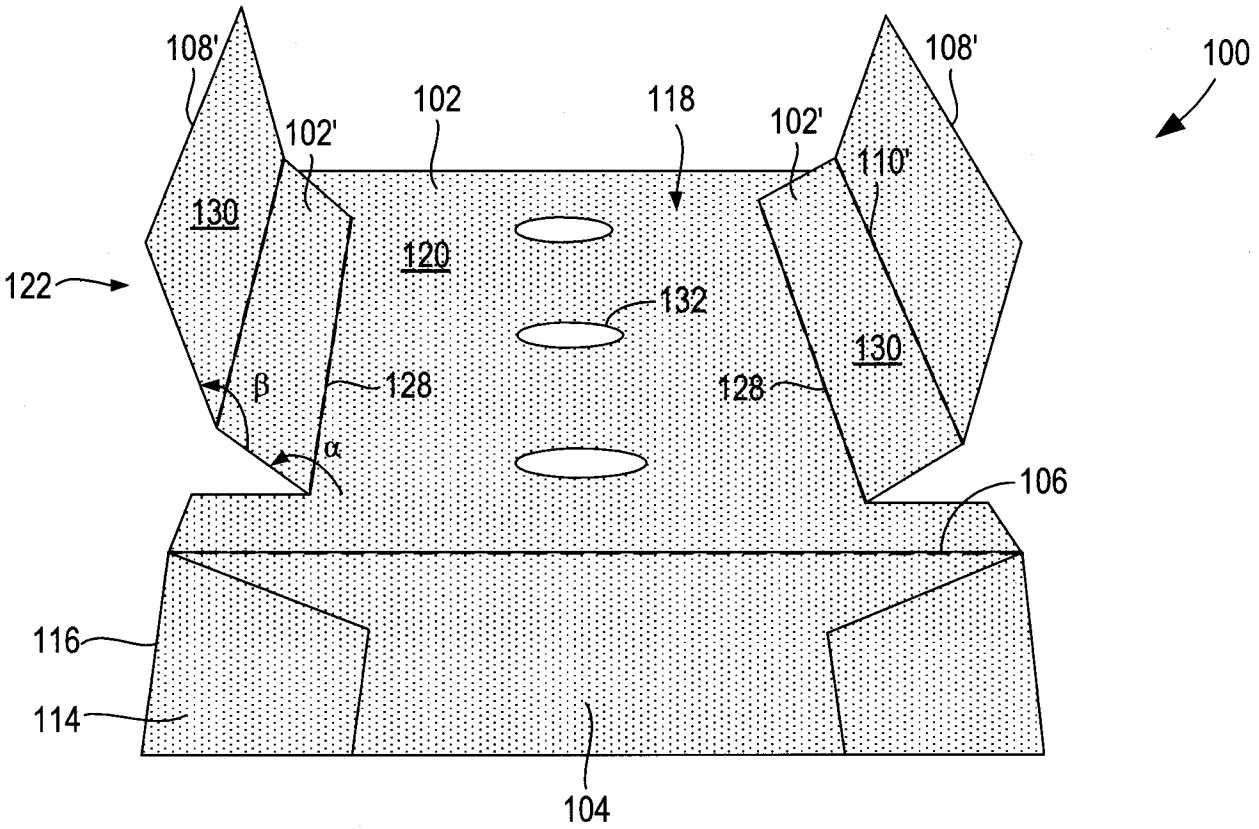
FIG. 1C is a schematic end view of the construct of FIG. 1B.

More particularly, as shown schematically in FIG. 1C, each panel 102' may be disposed at an angle $\alpha$ with respect to the platform 102. Likewise, each panel 108' may be disposed at an angle $\beta$ with respect to the respective adjacent panel 102'. In one example, the angles $\alpha$ and $\beta$ independently may be from about 90° to about 180°. In another example, the angles $\alpha$ and $\beta$ independently may be from about 90° to about 135°. In still another example, the angles $\alpha$ and $\beta$ independently may be from about 135° to about 180°. In each of various other examples, the angles $\alpha$ and $\beta$ independently may be from 90° to about 100°, from about 100° to about 120°, from about 120° to about 130°, from about 130° to about 140°, from about 140° to about 150°, from about 150° to about 160°, from about 160° to about 170°, or from about 170° to about 180°. In other examples, the angles $\alpha$ and $\beta$ independently may be less than 90°. However, numerous other configurations are contemplated by the invention.

To use the construct 100 according to one exemplary method, a food item F may be placed on the main panel or platform 102 between the side walls 122, as shown in FIG. 1B, and placed into a microwave oven (not shown). Panels 102', 108' of the side walls 122 may be adjusted inwardly, outwardly, upwardly, and/or downwardly, as needed to maximize contact between the food item F and the microwave energy interactive element 118 overlying and/or defining at least a portion of the interior surface 130 of the side walls 122. Likewise, the platform 102 may flex to accommodate the contours of the bottom of the food item F, for example, a French bread pizza.

During heating, the microwave energy interactive element 118 overlying the main panel 102 and the side walls 122, in this example, a susceptor, converts at least a portion of impinging microwave energy to thermal energy to enhance the heating, browning, and/or crisping of the surface of the food item F, for example, the crust of a French bread pizza. Additionally, by maintaining the food item F in an elevated position on the platform 102, the air in the void 112 between the platform 102 and the floor of the microwave oven may provide an insulating effect, thereby decreasing the amount of heat loss from the microwave energy interactive material of the susceptor 118 to the floor of the microwave oven. As a result, the heating of the food item and the browning and/or crisping of the bottom and sides of the food item may be enhanced further.

If desired, the construct 100 optionally may include one or more venting apertures 132 that allow water vapor or other gases to diffuse away from the food item F during heating, thereby improving browning and/or crisping of the food item. In this example, the construct 100 includes three apertures 132 substantially centrally aligned along the length of the platform 102, each aperture 132 being substantially circular in shape. However, it will be understood that the number, shape, spacing, and positioning of the apertures may vary depending on the food item to be heated and the desired degree of browning and crisping, as will be discussed further below.

Figure 1D:
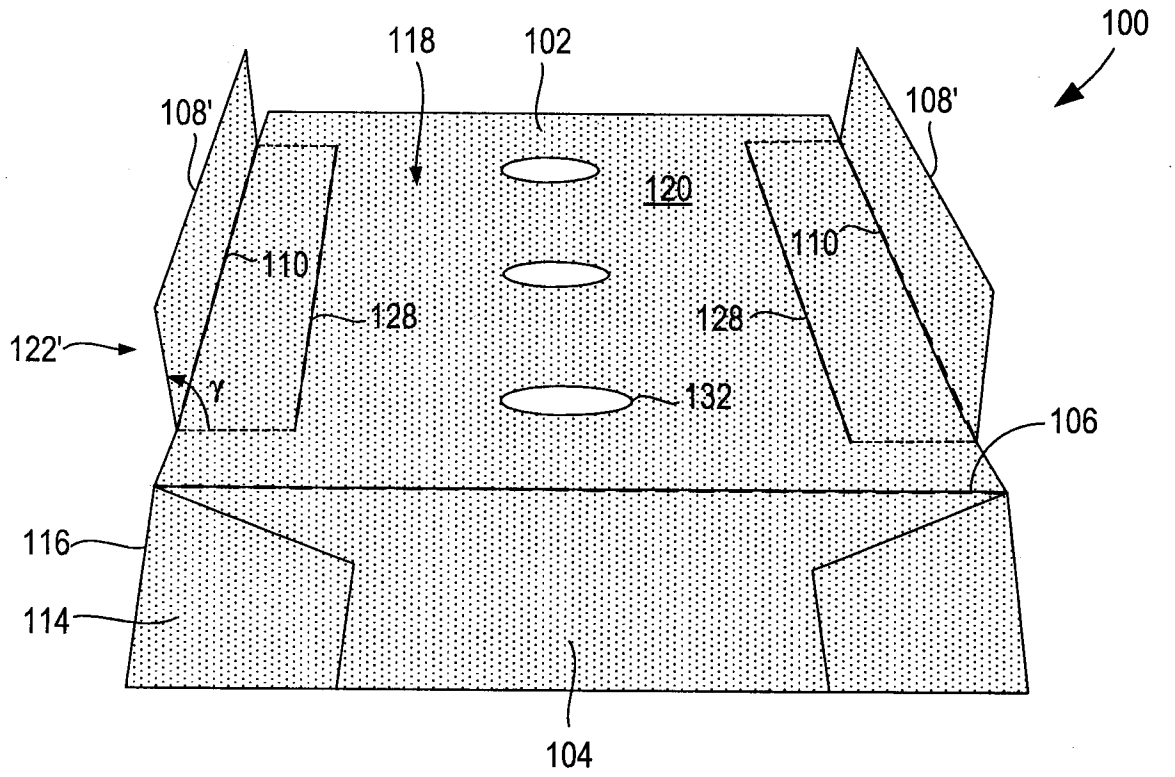
FIG. 1D is a schematic end view of the construct of FIG. 1B, having an alternate side wall configuration according to various aspects of the invention.

It will be apparent that, when the side walls 122 are formed, the overall shape and dimensions of the platform 102 differ from the original shape and dimensions. More particularly, in this configuration, the central portion 134 of the platform 102 is narrower than the end portions 136 of the platform 102 (FIG. 1B). It is contemplated that, in some instances, it may not be necessary and/or desirable to reduce the width of the platform 102 in this manner. For example, where a wider food item is to be heated, browned, and/or crisped, panel 108' may be formed into an alternate side wall 122' by separating the construct 100 along tear lines 124 and folding panels 108' along respective fold lines 110, as shown schematically in FIG. 1D. In such a case, panel 108' may form an angle γ with respect to the platform 102, which retains its original substantially rectangular shape. In one example, the angle γ may be from about 90° to about 180°. In another example, the angle γ may be from about 90° to about 135°. In still another example, the angle γ may be from about 135° to about 180°. In each of various other examples, the angle γ may be from 90° to about 100°, from about 100° to about 120°, from about 120° to about 130°, from about 130° to about 140°, from about 140° to about 150°, from about 150° to about 160°, from about 160° to about 170°, or from about 170° to about 180°. In other examples, the angle γ may be less than 90°.

Figure 1E:
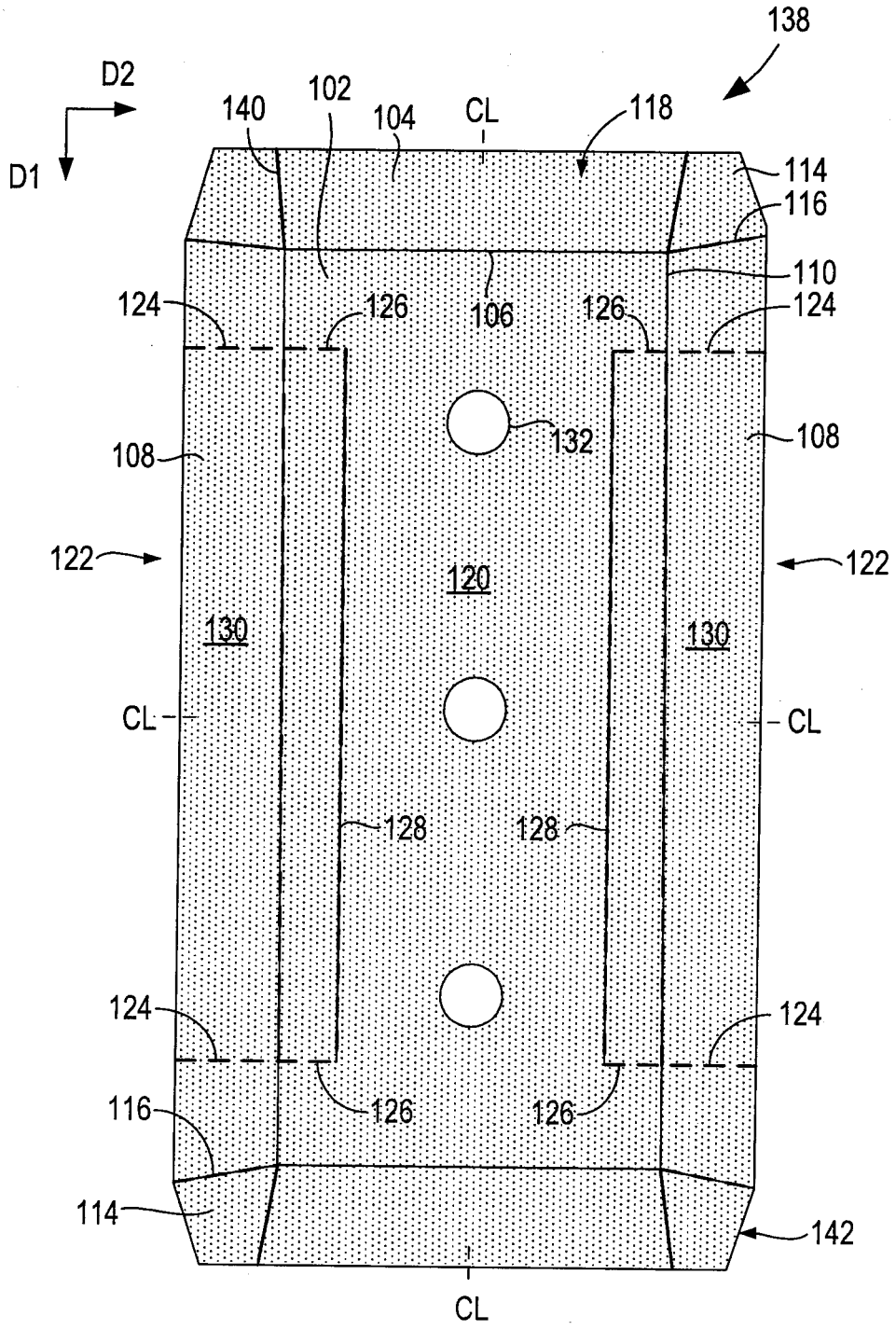
FIG. 1E is a schematic top plan view of an exemplary blank according to various aspects of the invention.
Figure 1F:
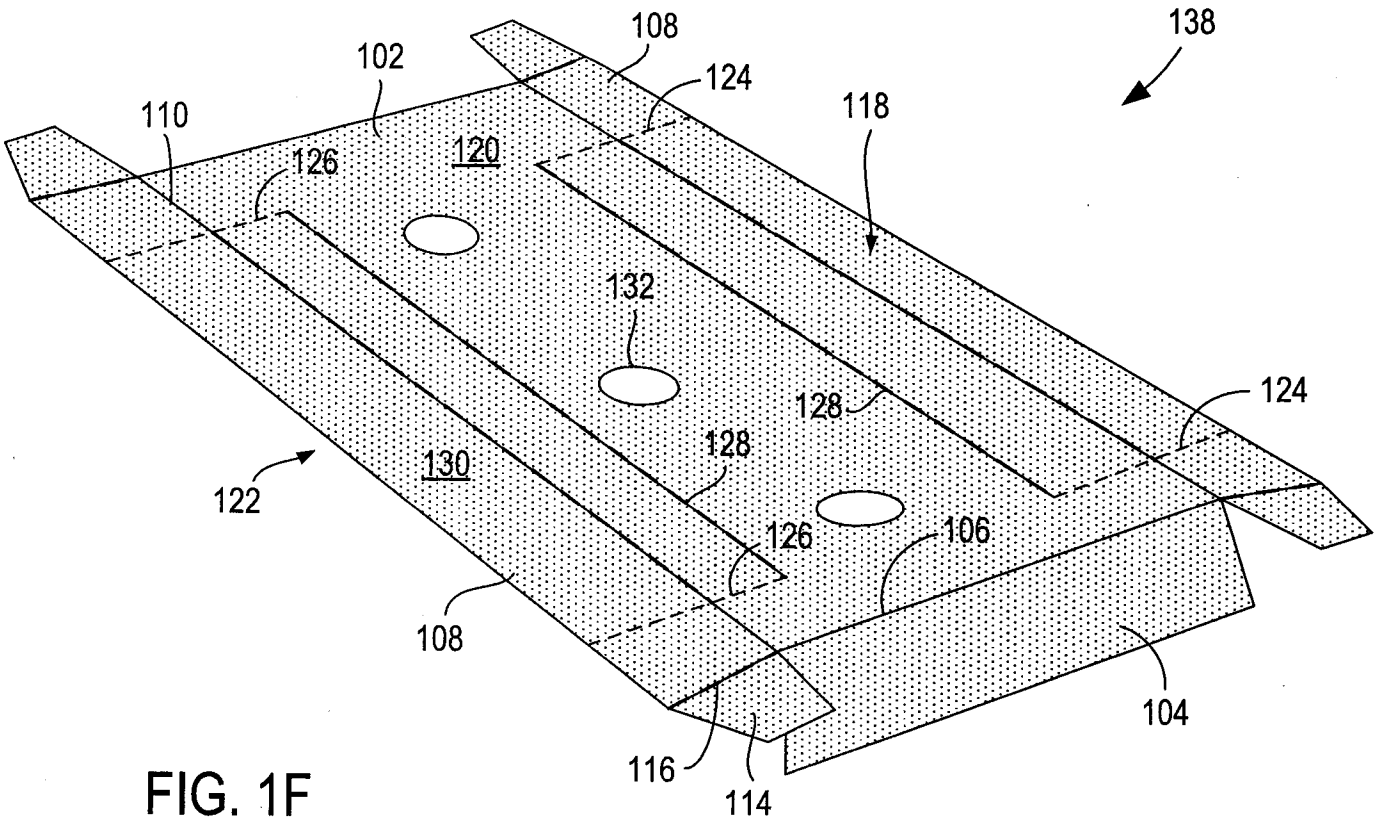
FIG. 1F is a schematic perspective view of the blank of FIG. 1E, partially erected into the construct of FIG. 1A.

FIG. 1E depicts a schematic top plan view of an exemplary blank 138 that may be used to form the construct 100 of FIG. 1A according to various aspects of the present invention. The blank 100 includes a plurality of panels joined along lines of disruption, for example, fold lines. The blank 100 and each of the various panels generally has a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the blank is manufactured or erected into the construct. The blank 138 may be symmetric or nearly symmetric about a transverse centerline CT and along a longitudinal centerline CL. Therefore, certain elements in the drawing figures may have similar or identical reference numerals to reflect the whole or partial symmetry.

As shown in FIG. 1E, the blank 138 includes a main panel 102 suitable, for example, for heating a French bread pizza or sandwich thereon. End panels 104 extend from a first pair of substantially parallel peripheral edges of the main panel 102 along respective transverse fold lines 106. Side panels 108 extend from a second pair of peripheral edges along respective longitudinal fold lines 110, such that fold lines 106, 110 are substantially perpendicular. In this example, the end panels 104 and side panels 108 are substantially trapezoidal in shape, with the wider "leg" or "base" of each trapezoidal panel defining a portion of a peripheral edge 142 of the blank 138. However, other shapes are contemplated hereby. End flaps (i.e. glue flaps) 114 extend from opposed longitudinal ends of each side panel 108 along respective oblique fold lines 116. End flaps 114 are separated from the respective end panels 104 by respective oblique cuts 140.

The blank 138 also includes a plurality of lines of disruption, for example, substantially collinear transverse tear lines 124, 126 and longitudinal fold lines 128, which collectively define a pair of substantially opposed wall portions 122. Fold lines 128 extend substantially between respective the end points of tear lines 126 and are substantially parallel to longitudinal fold lines 110.

A microwave energy interactive element 118 (shown schematically by stippling), for example, a susceptor, optionally may overlie all or a portion of the various panels of the blank 138. In this example, the microwave energy interactive element 118 overlies substantially all of one surface of the blank 138 and at least partially defines a food-contacting surface 120.

If desired, the blank 138 may include one or more venting apertures 132 extending through the thickness of the blank 138, as will be discussed further below.

According to one exemplary method of forming of the blank 138 into the construct 100, end panels 104 may be folded along fold lines 106 out of the plane of the main panel 102 away from the food-contacting surface 120. Likewise, side panels 108 may be folded along fold lines 110 out of plane of the main panel 102 away from the food-contacting surface. End flaps 114 may be folded towards end panels 106 along oblique fold lines 116 and may, if desired, be joined to the respective end panels 104 using glue, other adhesives, or any other suitable chemical or mechanical means or fasteners to form the construct 100, as shown in FIG. 1A.

As discussed previously, walls 122 may be formed by separating the various panels along tear lines 124, 126, and folding panels 108', 102' out of the plane of the platform 102 as needed for the particular food item. Alternatively, walls 122' may be formed by separating the various panels along tear lines 124 and folding panel 108' along fold line 110 towards the surface of the food item.

Numerous materials may be suitable for use in forming the various blanks and constructs of the invention, provided that the materials are resistant to softening, scorching, combusting, or degrading at typical microwave oven heating temperatures, for example, from about 250° F. to about 425° F. The particular materials used may include microwave energy interactive materials and microwave energy transparent or inactive materials.

For example, any of the various blanks and/or constructs of the present invention may include one or more features that alter the effect of microwave energy during the heating or cooking of the food item. For instance, the construct may include one or more microwave energy interactive elements (hereinafter sometimes referred to as "microwave interactive elements") that promote browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular microwave heating construct and food item.

The microwave interactive element may be supported on a microwave inactive or transparent substrate for ease of handling and/or to prevent contact between the microwave interactive material and the food item. As a matter of convenience and not limitation, and although it is understood that a microwave interactive element supported on a microwave transparent substrate includes both microwave interactive and microwave inactive elements or components, such constructs may be referred to herein as "microwave interactive webs".

The microwave energy interactive material may be an electroconductive or semiconductive material, for example, a metal or a metal alloy provided as a metal foil; a vacuum deposited metal or metal alloy; or a metallic ink, an organic ink, an inorganic ink, a metallic paste, an organic paste, an inorganic paste, or any combination thereof. Examples of metals and metal alloys that may be suitable for use with the present invention include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide. Examples of metal oxides that may be suitable for use with the present invention include, but are not limited to, oxides of aluminum, iron, and tin, used in conjunction with an electrically conductive material where needed. Another example of a metal oxide that may be suitable for use with the present invention is indium tin oxide (ITO). ITO can be used as a microwave energy interactive material to provide a heating effect, a shielding effect, a browning and/or crisping effect, or a combination thereof. For example, to form a susceptor, ITO may be sputtered onto a clear polymer film. The sputtering process typically occurs at a lower temperature than the evaporative deposition process used for metal deposition. ITO has a more uniform crystal structure and, therefore, is clear at most coating thicknesses. Additionally, ITO can be used for either heating or field management effects. ITO also may have fewer defects than metals, thereby making thick coatings of ITO more suitable for field management than thick coatings of metals, such as aluminum.

Alternatively, the microwave energy interactive material may comprise a suitable electroconductive, semiconductive, or non-conductive artificial dielectric or ferroelectric. Artificial dielectrics comprise conductive, subdivided material in a polymeric vehicle or other suitable matrix or binder, and may include flakes of an electroconductive metal, for example, aluminum.

In one example, the microwave interactive element may comprise a thin layer of microwave interactive material (generally less than about 100 angstroms in thickness, for example, from about 60 to about 100 angstroms in thickness) that tends to absorb at least a portion of impinging microwave energy and convert it to thermal energy (i.e., heat) at the interface with a food item. Such elements often are used to promote browning and/or crisping of the surface of a food item (sometimes referred to as a "browning and/or crisping element"). When supported on a film or other substrate, such an element may be referred to as a "susceptor film" or, simply, "susceptor". In the example shown in FIG. 1E, the blank 138 includes a susceptor film 118 substantially overlying and joined to at least a portion of the blank 138 to form at least a portion of a first surface 120, which may serve as a food-contacting or food bearing surface. However, other microwave energy interactive elements, such as those described herein, are contemplated for use with the invention. A second surface 144 (FIG. 1B) opposite the first surface 120 also may include one or more microwave energy interactive elements if desired.

In another example, the microwave interactive element may comprise a foil having a thickness sufficient to shield one or more selected portions of the food item from microwave energy (sometimes referred to as a "shielding element"). Such shielding elements may be used where the food item is prone to scorching or drying out during heating.

The shielding element may be formed from various materials and may have various configurations, depending on the particular application for which the shielding element is used. Typically, the shielding element is formed from a conductive, reflective metal or metal alloy, for example, aluminum, copper, or stainless steel, in the form of a solid "patch". The shielding element generally may have a thickness of from about 0.000285 inches to about 0.05 inches. In one aspect, the shielding element has a thickness of from about 0.0003 inches to about 0.03 inches. In another aspect, the shielding element has a thickness of from about 0.00035 inches to about 0.020 inches, for example, 0.016 inches.

As still another example, the microwave interactive element may comprise a segmented foil or high optical density evaporated material (collectively referred to as "segmented foil"), such as, but not limited to, those described in U.S. Pat. Nos. 6,204,492, 6,433,322, 6,552,315, and 6,677,563, each of which is incorporated by reference in its entirety. Although segmented foils are not continuous, appropriately spaced groupings of such segments often act as a transmitting element to direct microwave energy to specific areas of the food item. Such foils also may be used in combination with browning and/or crisping elements, for example, susceptors.

Any of the numerous microwave interactive elements described herein or contemplated hereby may be substantially continuous, that is, without substantial breaks or interruptions, or may be discontinuous, for example, by including one or more breaks or apertures that transmit microwave energy therethrough. The breaks or apertures may be sized and positioned to heat particular areas of the food item selectively. The number, shape, size, and positioning of such breaks or apertures may vary for a particular application depending on type of construct being formed, the food item to be heated therein or thereon, the desired degree of shielding, browning, and/or crisping, whether direct exposure to microwave energy is needed or desired to attain uniform heating of the food item, the need for regulating the change in temperature of the food item through direct heating, and whether and to what extent there is a need for venting.

It will be understood that the aperture may be a physical aperture or void (e.g., venting apertures 132) in the material used to form the construct, or may be a non-physical "aperture". A non-physical aperture may be a portion of the construct that is microwave energy inactive by deactivation or otherwise, or one that is otherwise transparent to microwave energy. Thus, for example, the aperture may be a portion of the construct formed without a microwave energy active material or, alternatively, may be a portion of the construct formed with a microwave energy active material that has been deactivated. While both physical and non-physical apertures allow the food item to be heated directly by the microwave energy, a physical aperture also provides a venting function to allow steam or other vapors to be released from the food item.

In some instances, it may be beneficial to create one or more discontinuities or inactive regions to prevent overheating or charring of the construct. By way of example, and not limitation, in the construct 100 illustrated in FIGS. 1A-1C, the end flaps 114 and a portion of the end panels 104 are overlapped and in intimate and/or proximate contact with one another. When exposed to microwave energy, the concentration of heat generated by the overlapped panels may be sufficient to cause the underlying support, in this case, paperboard, to become scorched. As such, the overlapping portions of panels 104, 114 may be designed to be microwave energy transparent, for example, by forming these areas of the blank 138 without a microwave energy interactive material, removing any microwave energy interactive material that has been applied, or by deactivating the microwave energy interactive material in these areas.

Further still, one or more panels, portions of panels, or portions of the construct may be designed to be microwave energy inactive to ensure that the microwave energy is focused efficiently on the areas to be browned and/or crisped, rather than being lost to portions of the food item not intended to be browned and/or crisped or to the heating environment. By way of example, and not limitation, in the construct 100 illustrated in FIG. 1A, end panels 104 are in a substantially vertical configuration extending downwardly from the main panel 102 on which the food item rests. In this configuration, the end panels 104 are not likely to be in proximate or intimate contact with any portion of the food item intended to be browned and/or crisped. This may be achieved using any suitable technique, such as those described above.

As stated above, any of the above elements and numerous others contemplated hereby may be supported on a substrate. The substrate typically comprises an electrical insulator, for example, a polymer film or other polymeric material. As used herein, the term "polymer" or "polymeric material" includes, but is not limited to, homopolymers, copolymers, such as for example, block, graft, random, and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic, and random symmetries.

The thickness of the film typically may be from about 35 gauge to about 10 mil. In one aspect, the thickness of the film is from about 40 to about 80 gauge. In another aspect, the thickness of the film is from about 45 to about 50 gauge. In still another aspect, the thickness of the film is about 48 gauge. Examples of polymer films that may be suitable include, but are not limited to, polyolefins, polyesters, polyamides, polyimides, polysulfones, polyether ketones, cellophanes, or any combination thereof. Other non-conducting substrate materials such as paper and paper laminates, metal oxides, silicates, cellulosics, or any combination thereof, also may be used.

In one example, the polymer film comprises polyethylene terephthalate (PET). Polyethylene terephthalate films are used in commercially available susceptors, for example, the QWIKWAVE® Focus susceptor and the MICRORITE® susceptor, both available from Graphic Packaging International (Marietta, Ga.). Examples of polyethylene terephthalate films that may be suitable for use as the substrate include, but are not limited to, MELINEX®, commercially available from DuPont Teijan Films (Hopewell, Va.), SKYROL, commercially available from SKC, Inc. (Covington, Ga.), and BARRIALOX PET, available from Toray Films (Front Royal, Va.), and QU50 High Barrier Coated PET, available from Toray Films (Front Royal, Va.).

The polymer film may be selected to impart various properties to the microwave interactive web, for example, printability, heat resistance, or any other property. As one particular example, the polymer film may be selected to provide a water barrier, oxygen barrier, or a combination thereof. Such barrier film layers may be formed from a polymer film having barrier properties or from any other barrier layer or coating as desired. Suitable polymer films may include, but are not limited to, ethylene vinyl alcohol, barrier nylon, polyvinylidene chloride, barrier fluoropolymer, nylon 6, nylon 6,6, coextruded nylon 6/EVOH/nylon 6, silicon oxide coated film, barrier polyethylene terephthalate, or any combination thereof.

One example of a barrier film that may be suitable for use with the present invention is CAPRAN® EMBLEM 1200M nylon 6, commercially available from Honeywell International (Pottsville, Pa.). Another example of a barrier film that may be suitable is CAPRAN®OXYSHIELD OBS monoaxially oriented coextruded nylon 6/ethylene vinyl alcohol (EVOH)/nylon 6, also commercially available from Honeywell International. Yet another example of a barrier film that may be suitable for use with the present invention is DARTEK® N-201 nylon 6,6, commercially available from Enhance Packaging Technologies (Webster, N.Y.). Additional examples include BARRIALOX PET, available from Toray Films (Front Royal, Va.) and QU50 High Barrier Coated PET, available from Toray Films (Front Royal, Va.), referred to above.

Still other barrier films include silicon oxide coated films, such as those available from Sheldahl Films (Northfield, Minn.). Thus, in one example, a susceptor may have a structure including a film, for example, polyethylene terephthalate, with a layer of silicon oxide coated onto the film, and ITO or other material deposited over the silicon oxide. If needed or desired, additional layers or coatings may be provided to shield the individual layers from damage during processing.

The barrier film may have an oxygen transmission rate (OTR) as measured using ASTM D3985 of less than about 20 $cc/m^2/day$. In one aspect, the barrier film has an OTR of less than about 10 $cc/m^2/day$. In another aspect, the barrier film has an OTR of less than about 1 $cc/m^2/day$. In still another aspect, the barrier film has an OTR of less than about 0.5 $cc/m^2/day$. In yet another aspect, the barrier film has an OTR of less than about 0.1 $cc/m^2/day$.

The barrier film may have a water vapor transmission rate (WVTR) of less than about 100 $g/m^2/day$ as measured using ASTM F1249. In one aspect, the barrier film has a WVTR of less than about 50 $g/m^2/day$. In another aspect, the barrier film has a WVTR of less than about 15 $g/m^2/day$. In yet another aspect, the barrier film has a WVTR of less than about 1 $g/m^2/day$. In still another aspect, the barrier film has a WVTR of less than about 0.1 $g/m^2/day$. In a still further aspect, the barrier film has a WVTR of less than about 0.05 $g/m^2/day$.

Other non-conducting substrate materials such as metal oxides, silicates, cellulosics, or any combination thereof, also may be used in accordance with the present invention.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item.

For example, the microwave energy interactive material may be provided as a continuous or discontinuous layer or coating including circles, loops, hexagons, islands, squares, rectangles, octagons, and so forth. Examples of various patterns and methods that may be suitable for use with the present invention are provided in U.S. Pat. Nos. 6,765,182; 6,717,121; 6,677,563; 6,552,315; 6,455,827; 6,433,322; 6,414,290; 6,251,451; 6,204,492; 6,150,646; 6,114,679; 5,800,724; 5,759,422; 5,672,407; 5,628,921; 5,519,195; 5,424,517; 5,410,135; 5,354,973; 5,340,436; 5,266,386; 5,260,537; 5,221,419; 5,213,902; 5,117,078; 5,039,364; 4,963,424; 4,936,935; 4,890,439; 4,775,771; 4,865,921; and Re. 34,683, each of which is incorporated by reference herein in its entirety. Although particular examples of patterns of microwave energy interactive material are shown and described herein, it should be understood that other patterns of microwave energy interactive material are contemplated by the present invention.

The microwave interactive element or microwave interactive web may be joined to or overlie a dimensionally stable, microwave energy transparent support (hereinafter referred to as "microwave transparent support", "microwave inactive support" or "support") to form the construct.

In one aspect, for example, where a rigid or semi-rigid construct is to be formed, all or a portion of the support may be formed at least partially from a paperboard material, which may be cut into a blank prior to use in the construct. For example, the support may be formed from paperboard having a basis weight of from about 60 to about 330 lbs/ream (lbs/3000 sq. ft.), for example, from about 80 to about 140 lbs/ream. The paperboard generally may have a thickness of from about 6 to about 30 mils, for example, from about 12 to about 28 mils. In one particular example, the paperboard has a thickness of about 12 mils. Any suitable paperboard may be used, for example, a solid bleached or solid unbleached sulfate board, such as SUS® board, commercially available from Graphic Packaging International.

In another aspect, where a more flexible construct is to be formed, the support may comprise a paper or paper-based material generally having a basis weight of from about 15 to about 60 lbs/ream, for example, from about 20 to about 40 lbs/ream. In one particular example, the paper has a basis weight of about 25 lbs/ream.

Optionally, one or more portions of the various blanks or other constructs described herein or contemplated hereby may be coated with varnish, clay, or other materials, either alone or in combination. The coating may then be printed over with product advertising or other information or images. The blanks or other constructs also may be coated to protect any information printed thereon.

Furthermore, the blanks or other constructs may be coated with, for example, a moisture and/or oxygen barrier layer, on either or both sides, such as those described above. Any suitable moisture and/or oxygen barrier material may be used in accordance with the present invention. Examples of materials that may be suitable include, but are not limited to, polyvinylidene chloride, ethylene vinyl alcohol, DuPont DARTEK™ nylon 6,6, and others referred to above.

Alternatively or additionally, any of the blanks or other constructs of the present invention may be coated or laminated with other materials to impart other properties, such as absorbency, repellency, opacity, color, printability, stiffness, or cushioning. For example, absorbent susceptors are described in U.S. Provisional Application No. 60/604,637, filed Aug. 25, 2004, and U.S. Patent Application Publication No. US 2006/0049190 A1, published Mar. 9, 2006, both of which are incorporated herein by reference in their entirety. Additionally, the blanks or other constructs may include graphics or indicia printed thereon.

It will be understood that with some combinations of elements and materials, the microwave interactive element may have a grey or silver color this is visually distinguishable from the substrate or the support. However, in some instances, it may be desirable to provide a web or construct having a uniform color and/or appearance. Such a web or construct may be more aesthetically pleasing to a consumer, particularly when the consumer is accustomed to packages or containers having certain visual attributes, for example, a solid color, a particular pattern, and so on. Thus, for example, the present invention contemplates using a silver or grey toned adhesive to join the microwave interactive elements to the substrate, using a silver or grey toned substrate to mask the presence of the silver or grey toned microwave interactive element, using a dark toned substrate, for example, a black toned substrate, to conceal the presence of the silver or grey toned microwave interactive element, overprinting the metallized side of the web with a silver or grey toned ink to obscure the color variation, printing the non-metallized side of the web with a silver or grey ink or other concealing color in a suitable pattern or as a solid color layer to mask or conceal the presence of the microwave interactive element, or any other suitable technique or combination thereof.

Various aspects of the invention may be illustrated further by way of the following examples, which are not to be construed as limiting in any manner.

EXAMPLE 1

A construct for heating, browning, and crisping a food item similar to the construct of FIGS. 1A-1C was formed from a blank similar to the blank of FIG. 1E. A commercially available French bread pizza was placed on the platform between the upwardly extending walls with the sides of the French bread pizza in proximate or intimate contact with the susceptor defining the interior surface of the walls. The French bread pizza was heated in a 1000 watt Panasonic microwave oven for about 3 minutes. Excellent heating, browning, and crisping of the French bread pizza was obtained.

EXAMPLE 2

A construct for heating, browning, and/or crisping a food item similar to the construct of FIGS. 1A-1C was formed using a blank similar to the blank of FIG. 1E. A commercially available French bread pizza was placed on the food bearing panel between the upwardly extending side panels or walls with the sides of the French bread pizza in proximate or intimate contact with the susceptor defining the interior surface of the walls. The French bread pizza was heated in an 800 watt Sharp microwave oven for about 2.5 minutes. Excellent heating, browning, and crisping of the French bread pizza was obtained.

It will be understood that in each of the various blanks and constructs described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; or any combination of these features.

A "tear line" can be any at least somewhat line-like arranged, although not necessarily straight, form of weakening that facilitates tearing therealong. More specifically, but not for the purpose of narrowing the scope of the present invention, a tear line may include: a slit that extends partially into the material along the desired line of weakness; and/or a series of spaced apart slits that extend partially into and/or completely through the material along the desired line of weakness; or any combination of these features.

As a more specific example, one type of conventional tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut. That is, it is within the scope of the present invention for each of the tear lines to be replaced with a continuous cut, slit, or the like.

Furthermore, various exemplary blanks and constructs are shown and described herein as having fold lines, tear lines, score lines, cuts or cut lines, kiss cut lines, and other lines as extending from a particular feature to another particular feature, for example from one particular panel to another, from one particular edge to another, or any combination thereof. However, it will be understood that such lines need not necessarily extend between such features in a precise manner. Instead, such lines may generally extend between the various features as needed to achieve the objective of such line. For instance, where a particular tear line is shown as extending from a first edge of a blank to another edge of the blank, the tear line need not extend completely to one or both of such edges. Rather, the tear line need only extend to a location sufficiently proximate to the edge so that the removable strip, panel, or portion can be manually separated from the blank or construct without causing undesirable damage thereto.

While various examples of constructs are provided herein, it will be understood that any configuration of components may be used as needed or desired. The construct may be flexible, semi-rigid, rigid, or may include a variety of components having different degrees of flexibility. Additionally, it should be understood that the present invention contemplates constructs for single-serving portions and for multiple-serving portions. It also should be understood that various components used to form the constructs of the present invention may be interchanged. Thus, while only certain combinations are illustrated herein, numerous other combinations and configurations are contemplated hereby.

Although certain embodiments of this invention have been described with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other.

It will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

It is intended that all matter contained in the above description or shown in the accompanying drawings shall be interpreted as illustrative only and not limiting. For example, various elements discussed with reference to the various embodiments may be interchanged to create entirely new embodiments coming within the scope of the present invention. Furthermore, changes in detail or structure may be made without departing from the spirit of the invention. Thus, the detailed description set forth herein is not intended nor is to be construed to limit the present invention or otherwise to exclude any such other embodiments, adaptations, variations, modifications, and equivalent arrangements of the present invention. Rather, the description is only illustrative and exemplary of the present invention and is made merely for purposes of providing a full and enabling disclosure of the present invention and to provide the best mode contemplated by the inventor or inventors of carrying out the invention.

Thus, while the present invention has been discussed above with reference to exemplary embodiments, various additions, modifications and changes can be made thereto without departing from the spirit and scope of the invention as set forth in the following claims.

What is claimed is:

1. A microwave heating construct for a food item, comprising:

a platform;

a layer of microwave energy interactive material overlying at least a portion of the platform;

a pair of side panels extending substantially downwardly from a first pair of opposed edges of the platform along respective first fold lines extending in a first direction, each side panel of the pair of side panels including a pair of substantially vertical lines of disruption defining at least a portion of an adjustable wall portion between the respective first fold line and a respective peripheral edge of the side panel opposite the first fold line, wherein each of the vertical lines of disruption of the respective pair of vertical lines of disruption extends in the respective side panel of the pair of side panels, and each of the adjustable wall portions extends in at least the respective side panel of the pair of side panels and is foldably connected to the platform; and a pair of end panels extending substantially downwardly from a second pair of opposed edges of the platform along respective second fold lines extending in a second direction substantially perpendicular to the first direction.

2. The construct of claim 1, wherein the layer of microwave energy interactive material further overlies each side panel of the pair of side panels between the respective pair of vertical lines of disruption.

3. The construct of claim 1, wherein the adjustable wall portions are adapted to be transformed into walls for the platform by tearing along the vertical lines of disruption in the side panels and rotating the adjustable wall portions upwardly along the respective first fold lines.

4. A microwave heating construct for a food item, comprising:

a platform;

a layer of microwave energy interactive material overlying at least a portion of the platform;

a pair of side panels extending substantially downwardly from a first pair of opposed edges of the platform along respective first fold lines extending in a first direction, each side panel of the pair of side panels including a pair of substantially vertical lines of disruption defining at least a portion of an adjustable wall portion between the respective first fold line and a respective peripheral edge of the side panel opposite the first fold line; and a pair of end panels extending substantially downwardly from a second pair of opposed edges of the platform along respective second fold lines extending in a second direction substantially perpendicular to the first direction;

wherein for each adjustable wall portion, the adjustable wall portion is further defined at least partially by a pair of tear lines extending in the second direction from the respective first fold line into the platform, the pair of tear lines being substantially aligned with the pair of vertical lines of disruption in the respective side panel.

5. The construct of claim 4, wherein for each adjustable wall portion, the adjustable wall portion is further defined at least partially by a line of disruption extending in the first direction substantially between endpoints of the respective pair of tear lines extending from the respective first fold line into the platform.

6. The construct of claim 5, wherein for each adjustable wall portion, the respective first fold line divides the adjustable wall portion into a proximal section disposed between the respective line of disruption extending in the first direction and the respective first fold line, and a distal section disposed between the respective first fold line and the respective peripheral edge of the adjustable wall portion.

7. The construct of claim 6, wherein each adjustable wall portion is adapted to be transformed into a wall for the platform by tearing along the vertical lines of disruption in the respective side panel and along the respective tear lines extending into the platform, and rotating at least one of the proximal section and distal section of the adjustable wall portion upwardly along at least one of the respective first fold line and the respective line of disruption extending in the first direction.

8. The construct of claim 7, wherein the platform is adapted to receive the food item, and the walls are adapted to hinge along the respective lines of disruption and respective first fold lines to bring the proximal section and distal section of each wall into proximity with the food item.

9. The construct of claim 7, wherein for at least one wall, the proximal section of the wall forms an angle with respect to the platform of from about 90° to about 180°.

10. The construct of claim 7, wherein for at least one wall, the distal section of the wall forms an angle with respect to the respective proximal section of from about 90° to about 180°.

11. The construct of claim 1, further comprising a respective pair of end flaps foldably joined to respective opposite ends of each side panel along respective oblique fold lines.

12. The construct of claim 11, wherein the end flaps of each respective pair of end flaps are in a substantially contacting, facing relationship with the respective end panel.

13. The construct of claim 11, wherein the end flaps are adhesively joined to the respective end panel.

14. The construct of claim 1, wherein the microwave energy interactive material is selected from the group consisting of aluminum, indium tin oxide, and any combination thereof.

15. The construct of claim 1, wherein the layer of microwave energy interactive material has a thickness of from about 60 to about 100 angstroms.

16. A microwave heating construct for a food item, comprising:

a platform including a central portion having a first dimension extending in a first direction and a second dimension extending in a second direction substantially perpendicular to the first direction, and a pair of end portions at opposite ends of the central portion, each end portion having a first dimension extending in the first direction and a second dimension extending in the second direction, the second dimension of each end portion being greater than the second dimension of the central portion;

a plurality of support elements extending downwardly from each end portion of the platform;

a pair of adjustable side walls, each adjustable side wall of the pair of adjustable side walls including a proximal panel hingedly joined to the central portion of the platform along a first fold line extending in the first direction, and a distal panel hingedly joined to the proximal panel along a second fold line extending in the first direction; and a layer of microwave energy interactive material overlying at least a portion of the platform and the side walls.

17. The construct of claim 16, wherein for each adjustable side wall of the pair of adjustable side walls, the proximal panel has a first dimension extending in the first direction and a second dimension extending in a crosswise direction transverse to the first direction, and the first dimension of the proximal panel is approximately equal to the first dimension of the central portion of the platform.

18. The construct of claim 16, wherein for each adjustable side wall of the pair of adjustable side walls, the proximal panel has a first dimension extending in the first direction and a second dimension extending in a crosswise direction transverse to the first direction, and the second dimension of the proximal panel is approximately equal to one-half of the second dimension of the end portions of the platform minus one-half of the second dimension of the central portion of the platform.

19. The construct of claim 16, wherein for each adjustable side wall of the pair of adjustable side walls, the distal panel has a first dimension extending in the first direction and a second dimension extending in a crosswise direction transverse to the first direction, and the first dimension of the distal panel is approximately equal to the first dimension of the central portion of the platform.

20. A blank for forming a construct, comprising:

a plurality of adjoined panels, each having a first dimension extending in a longitudinal direction and a second dimension extending in a transverse direction substantially perpendicular to the first direction, the plurality of panels including a main panel, a pair of substantially opposed side panels foldably joined to the main panel along respective substantially opposed longitudinal fold lines, and a pair of substantially opposed end panels foldably joined to the main panel along respective substantially opposed transverse fold lines; and a pair of substantially opposed side portions adapted to be at least partially separated from a remainder of the blank, each side portion of the pair of side portions being defined by a pair of substantially opposed transverse tear lines extending substantially across the respective side panel into the main panel, and a longitudinal line of disruption extending between the respective pair of substantially opposed transverse tear lines.

21. The construct of claim 1, wherein each of the vertical lines of disruption extends from the respective first fold line to the respective peripheral edge of the respective side panel of the pair of side panels.

22. A microwave heating construct, comprising:

a platform;

a side panel foldably connected to the platform along a first fold line, at least a portion of the side panel extending generally downwardly from the platform;

an end panel foldably connected to the platform along a second fold line, at least a portion of the end panel extending generally downwardly from the platform; and an adjustable wall portion extending in at least the platform and the side panel, the adjustable wall portion being foldably connected to the platform along a third fold line and being at least partially separable from the side panel along a line of disruption.

23. The construct of claim 22, wherein the line of disruption is a first line of disruption, and the adjustable wall portion is at least partially separable from the platform along a second line of disruption extending from an end of the first line of disruption to an end of the third fold line.

24. The construct of claim 23, wherein the adjustable wall portion is further at least partially separable from the side panel along a third line of disruption and from the platform along a fourth line of disruption, and the third line of disruption and the fourth line of disruption are spaced apart from the respective first line of disruption and second line of disruption.

25. The construct of claim 23, wherein the first line of disruption and the second line of disruption are tear lines.

26. The construct of claim 22, wherein the side panel is a first side panel, the adjustable wall portion is a first adjustable wall portion, and the line of disruption is a first line of disruption, and the construct further comprises a second side panel foldably connected to the platform along a fourth fold line and a second adjustable wall portion extending in at least the platform and the second side panel, the second adjustable wall portion being foldably connected to the platform along a fifth fold line and being at least partially separable from the second side panel along a second line of disruption.

27. The construct of claim 22, wherein the third fold line extends generally parallel to the first fold line and is spaced apart from the first fold line, and the line of disruption is generally perpendicular to the first fold line.

28. The construct of claim 22, wherein the second fold line extends generally perpendicular to the first fold line.

29. A blank for forming a microwave heating construct, the blank comprising:

a main panel for forming a raised platform when the construct is formed from the blank;

a side panel foldably connected to the main panel along a first fold line;

an end panel foldably connected to the main panel along a second fold line; and an adjustable wall portion extending in at least the main panel and the side panel, the adjustable wall portion being foldably connected to the main panel along a third fold line and being at least partially separable from the side panel along a line of disruption.

30. The blank of claim 29, wherein the line of disruption is a first line of disruption, and the adjustable wall portion is at least partially separable from the main panel along a second line of disruption extending from an end of the first line of disruption to an end of the third fold line.

31. The blank of claim 30, wherein the adjustable wall portion is further at least partially separable from the side panel along a third line of disruption and from the main panel along a fourth line of disruption, and the third line of disruption and the fourth line of disruption are spaced apart from the respective first line of disruption and second line of disruption.

32. The blank of claim 30, wherein the first line of disruption and the second line of disruption are tear lines.

33. The blank of claim 29, wherein the side panel is a first side panel, the adjustable wall portion is a first adjustable wall portion, and the line of disruption is a first line of disruption, and the blank further comprises a second side panel foldably connected to the main panel along a fourth fold line and a second adjustable wall portion extending in at least the main panel and the second side panel, the second adjustable wall portion being foldably connected to the main panel along a fifth fold line and being at least partially separable from the second side panel along a second line of disruption.

34. The blank of claim 29, wherein the third fold line extends generally parallel to the first fold line and is spaced apart from the first fold line, and the line of disruption is generally perpendicular to the first fold line.

35. The blank of claim 29, wherein the second fold line extends generally perpendicular to the first fold line.

* * * * *